US005465557A

United States Patent [19]

Harte

[11] Patent Number: 5,465,557

[45] Date of Patent: Nov. 14, 1995

[54] HINGE ASSEMBLY FOR VACUUM PACKAGING MACHINE

[75] Inventor: James R. Harte, Overland Park, Kans.

[73] Assignee: Koch Supplies, Inc., Kansas City, Mo.

[21] Appl. No.: 257,555

[22] Filed: Jun. 9, 1994

[51] Int. Cl.[6] ..... B65B 31/00

[52] U.S. Cl. ..... 53/510; 16/357; 16/361; 16/289; 16/298

[58] Field of Search ..... 53/432, 510; 16/289, 16/306, 357, 348, 361, 298; 74/569, 522, 525, 546, 586

[56] References Cited

U.S. PATENT DOCUMENTS

| | | | |
|---|---|---|---|
| 969,189 | 9/1910 | Rademacher | 81/394 |
| 2,233,882 | 1/1938 | Bobek | 16/348 |
| 3,523,323 | 8/1970 | Jorgensen | 16/288 |
| 3,555,590 | 1/1971 | Halopoff | 16/298 |
| 4,418,805 | 12/1983 | Wolff | 206/279 |
| 4,736,491 | 4/1988 | Mertes | 16/358 |
| 4,827,569 | 5/1989 | Mertes | 16/288 |
| 5,050,270 | 9/1991 | Burgei et al. | 16/306 |
| 5,116,099 | 5/1992 | Kwasnik et al. | 297/194 |
| 5,265,954 | 11/1993 | Keil | 312/405 |

*Primary Examiner*—John Sipos
*Assistant Examiner*—Gene L. Kim
*Attorney, Agent, or Firm*—Litman, McMahon and Brown

[57] ABSTRACT

An improved hinge assembly for a vacuum packaging machine is designed to pivotally connect a stainless steel tub in the machine to a sealing lid. The lid is equipped with a pair of the hinge assemblies, with each hinge assembly including a stationary hinge plate which is positioned beneath a rear, overhanging lip of the tub. A pair of pins are spaced apart and extend outward from each hinge plate and into and through an arcuate slot in a movable hinge block which is, in turn, connected to the lid. The hinge block is designed to move relative to the hinge plate along a path dictated by the arcuate slot and the pins, with the pins acting as respective stops for the movement. A gas spring is pivotally connected between the rear surface of the machine and each hinge block, with the hinge blocks including different mounting points to vary the effectiveness of the springs. The springs automatically lift the lid and the dual pin and arcuate slot connection between each hinge block and hinge plate creates a virtual pivot point behind the machine at the radial center of the slot's arc. This allows a relatively weak spring to raise the lid and also allows the lid to be pivoted to a larger angle than prior art hinges.

7 Claims, 2 Drawing Sheets

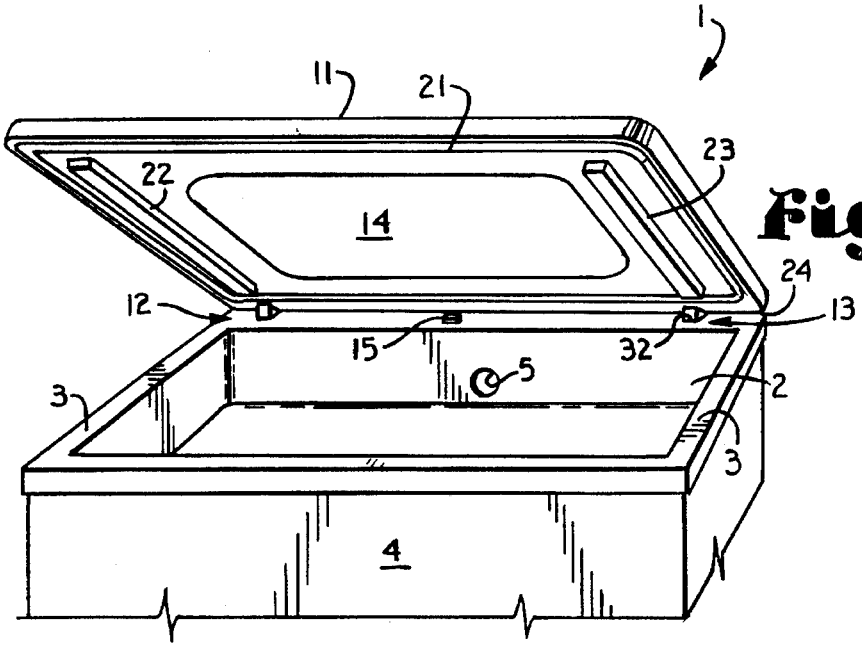
Fig.1.
Fig.2.
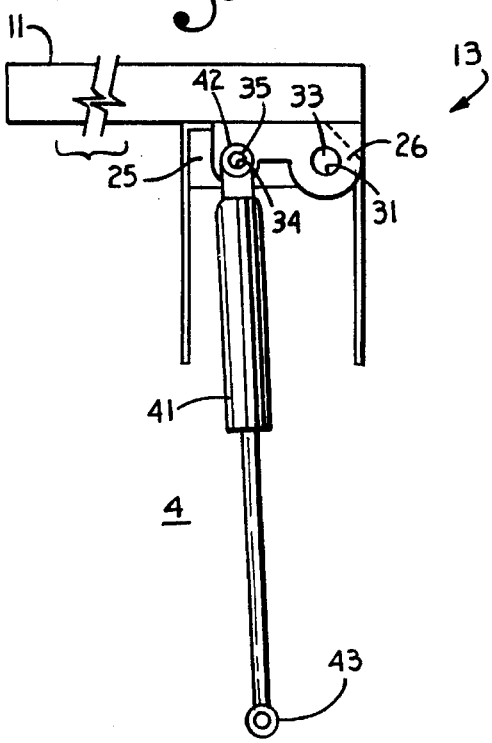
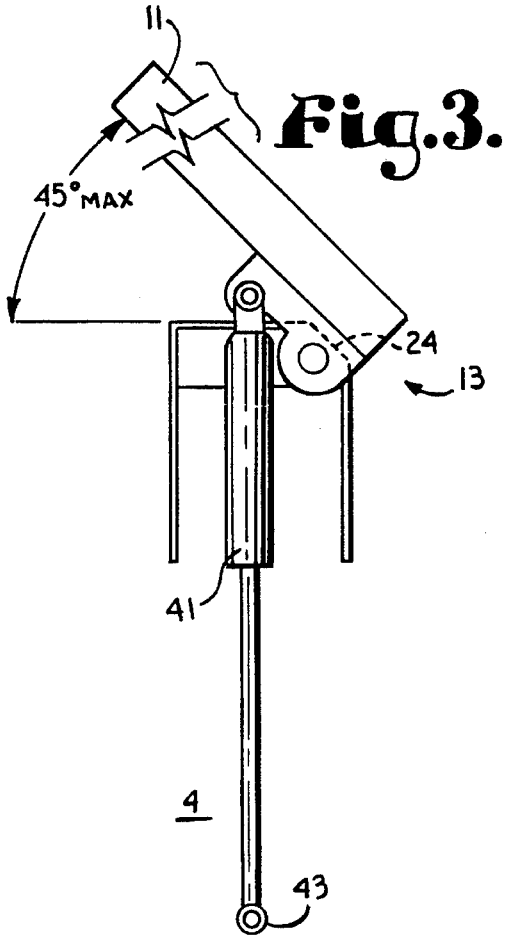
Fig.3.

HINGE ASSEMBLY FOR VACUUM PACKAGING MACHINE

BACKGROUND OF THE INVENTION

1. Field of the Invention

This invention is directed to an improved hinge assembly for a vacuum packaging machine. More particularly, the inventive hinge assembly is equipped with a movable hinge block with an arcuate slot therein and a stationary hinge plate with pins extending outward therefrom which collectively result in a virtual pivot point for a lid which is outboard of the machine. The hinge assembly allows increased access to the machine by pivoting the lid to a greater angle and also creates an increased moment arm so that smaller lid lifting springs can be used.

2. Description of the Related Art

Packaging within a vacuum can add significantly to the shelf life of certain foods such as meats, dairy products, etc. Vacuum packaging machines designed for packaging of such foodstuffs within an evacuated chamber have been in use for many years. Typically such machines have a stainless steel tub within which is positioned a heat sealing apparatus. The tub is equipped with a hinged lid with perimeter seals for sealing the top of the tub when the lid is closed. A vacuum pump is connected to the tub. Food to be packaged is put in a heat sealable wrap and the wrapped food is positioned in the tub. The lid is closed by an operator and a vacuum is drawn on the tub, temporarily keeping the lid closed and sealed. The heat sealing apparatus is then operated to seal the package, thus yielding an air evacuated, sealed food package, whereupon the vacuum seal is released and the lid automatically raises due to the lifting action of gas springs or the like.

In order for the lids to properly seal the vacuum tubs and withstand the considerable forces exerted by the vacuum, they are generally quite heavy. Vacuum forces within a typical machine can approach 15 lbs. per square inch. This means that a typical lid made of clear Lexan must be a full one inch thick, weighing upwards of 40 pounds. Prior art vacuum packaging machines have used conventional hinges on these lids with pivot points near and inboard of the rear of the tub. In order to provide uninterrupted access to the front and sides of the machine to load and unload food packages, no lifting mechanism can be placed in these areas. This means that the lifting mechanisms, e.g. gas springs, for lifting the lid must be positioned closely adjacent to the hinges at the rear of the tub, thus limiting the effective gas spring lifting moment arm to a length of about one inch. This requirement also limits the placement points for the gas springs to a single position, thus virtually eliminating any ability to adjust spring leverage. With a forty pound lid and just a one inch moment arm, prior art machines have needed to use dual lifting gas springs, each with capacities of 150 lbs or more. Constant opening and closing of the heavy lids against the force of these large capacity springs places considerable stress on the machine components, including the lid connection to the hinges, the connections between the springs and the hinges and the hinge components themselves. Furthermore, these machines are usually used in refrigerated environments, which reduces the effectiveness of even new gas springs by 5% or more. In a machine which requires 150 pound capacity springs for effective lid operation, this percentage reduction can have a serious impact on the speed and efficiency of lid operation, thus reducing the potential throughput of food packages.

In addition, on prior art machines, the placement of the hinge pivot point inboard of the rear of the machine necessitates that the rear lip of the stainless steel tub be radiused to accommodate the lid when it opens. Manufacturing production of a tub with a radiused rear edge is considerably more expensive than a tub with just square surfaces.

It is clear then, that a need exists for a vacuum packaging machine with an improved hinge assembly. Such a hinge assembly should preferably be capable of operation by smaller capacity gas springs, should allow adjustment of spring attachment position, and should be compatible with vacuum tubs with squared rear edges. In addition, the improved hinge assembly should reduce the stresses placed on component parts by the lifting mechanism and should be relatively simple and economical to manufacture.

SUMMARY OF THE INVENTION

In the practice of the present invention, a vacuum packaging machine includes a stainless steel vacuum tub which is selectively covered by a lid. The lid is pivotally attached to the rear of the machine tub via a pair of hinge assemblies. Each hinge assembly includes a stationary hinge plate which is positioned beneath a rear, overhanging lip of the tub. A pair of pins are spaced apart and extend outward from the hinge plate and into and through an arcuate slot in a movable hinge block. The hinge block is thus designed to move relative to the hinge plate along a path dictated by the arcuate slot and the pins. Each hinge block is positioned within and is movable through a respective one of a pair of rectangular slots within the tub rear lip. A top surface of each hinge block is connected to a rear bottom surface of the lid, via bolts or the like, with the hinge blocks positioned on respective opposite sides of the lid. The lower end of each of a pair of gas springs is pivotally connected to a rear surface of the machine beneath the lip of the tub. The upper end of each spring is connected to a respective one of the hinge blocks on a side opposite the corresponding hinge plate.

After a vacuum has been released within the vacuum tub, the lid is automatically lifted by the gas springs. The dual pin and arcuate slot connection between each hinge block and hinge plate creates a virtual pivot point behind the machine at the radial center of the slot's arc. This means that each gas spring is exerting a force on the lid which is based upon a lifting moment arm which is somewhat greater than the radius of the arcuate slot. Also, the virtual pivot point of the inventive hinge allows the lid to be raised to a greater angle, e.g. 60 degrees from horizontal, than would be possible with an ordinary hinge.

OBJECTS AND ADVANTAGES OF THE INVENTION

The principle objects and advantages of the present invention include: to provide an improved hinge assembly for a vacuum packaging machine; to provide such a hinge assembly which includes a movable hinge block with an arcuate slot and a stationary hinge plate; to provide such a hinge assembly in which the hinge plate has a pair of pins spaced apart and extending into and through the arcuate slot in the corresponding hinge block; to provide such a hinge assembly in which the pair of pins are slidable within the arcuate slot such that the hinge block is movable relative to the corresponding hinge plate through a path dictated by the arcuate slot and pins, resulting in a virtual pivot point at the radial center of the arcuate slot; to provide a vacuum packaging machine in which each of a pair of hinge blocks is connected to the bottom of a vacuum sealing lid; to provide such a machine in which a gas spring is connected between the rear of the machine and each hinge block such that the gas springs normally bias the respective hinge blocks upward relative to the corresponding hinge plates, thus raising the lid; to provide such a machine in which relatively small capacity gas springs can be used to raise a heavy lid; to provide such a machine in which the lid can be raised to a greater angle than with known machines; and to provide such a machine and hinge assembly which is reliable, economical to manufacture, and which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary, perspective view of the top portion of a vacuum packaging machine with a sealing lid hinged according to the prior art and illustrated in an open position.

FIG. 2 is a fragmentary, partially schematic view of a hinge assembly according to the prior art, illustrating the attached lid in a closed position.

FIG. 3 is a fragmentary, partially schematic view of a hinge assembly according to the prior art, illustrating the attached lid in an open position.

DETAILED DESCRIPTION OF THE INVENTION

I. Introduction and Environment

Figure 5:
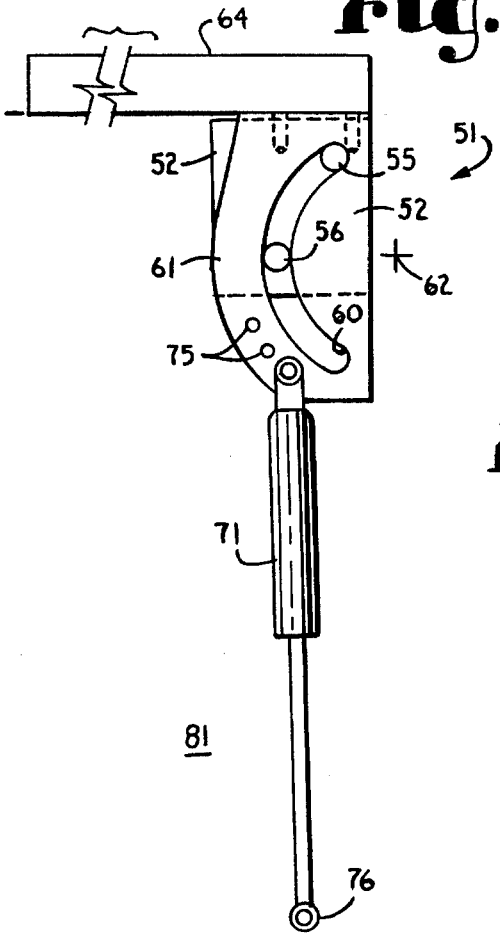
FIG. 5 is a fragmentary, partially schematic view of an assembled hinge assembly according to the present invention, illustrating the attached lid in a closed position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. The words "inward" and "outward" will refer to directions toward and away from, respectively, the geometric center of the embodiment being described and designated parts thereof. Said terminology will include the words specifically mentioned, derivatives thereof and words of a similar import.

II. Prior Art

Referring to the drawings in more detail, FIGS. 1–3 illustrate a vacuum packaging machine with a lid hinged according to the prior art, with the machine generally designated as 1 in FIG. 1. The machine 1 includes a rectangular, stainless steel vacuum tub 2 with a surrounding lip 3. The tub 2 is positioned in a recess within a machine housing 4 and a vacuum pump (not shown) is connected to the tub 2 via an opening 5. A heating element (also not shown) is positioned within the housing 4 beneath the tub 2 for heating a food package placed within the tub 2. A lid 11, conventionally made of Lexan or a similar, clear plastic material, is attached to the machine 1 via a pair of hinge assemblies 12 and 13. The lid 11 can be formed with a centered bubble or protrusion 14 to increase the effective volume of the tub 2. A microswitch 15 closes a circuit when the lid 11 is pushed closed, thus controlling the vacuum pump to draw a vacuum within the space defined by the tub 2 and the closed lid 11. The lid 11 includes a perimeter seal 21 to seat against the lip 3 to effectively seal the junction between the lid 11 and the tub lip 3. Once a vacuum is drawn within the tub 2, the lid 11 will be held in place by the vacuum forces, which can reach 15 lbs per square inch. A pair of reinforcing rods 22 and 23 are attached to the underneath side of the lid 11 immediately in front of the respective hinge assemblies 12 and 13. The tub lip 3 has a radiused rear portion 24 which is angled downward approximately 45 degrees to accommodate the rear portion of the lid 11 when it is raised.

Referring to FIGS. 2 and 3, the prior art hinge assembly 13 is shown connected between the lid 11 and an upper portion 25 of the housing 4, it being understood that the other hinge assembly 12 is a mirror image of the hinge assembly 13. The hinge assembly 13 includes a hinge block 26 with a horizontally oriented rear bore 31 extending therethrough. The hinge block 26 is positioned within a slot 32 (FIG. 1) in the rear tub lip 24. A pivot pin 33 extends from the upper housing portion 25 through the rear bore 31 to act as a pivot point for the hinge block 26. The hinge block 26 also has a front bore 34 with a bolt 35 extending therethrough. A gas spring or shock 41 is pivotally connected at an upper connector 42 to the bolt 35 and at a lower connector 43 to the housing 4. The gas spring 41 acts to urge front of the hinge block 26 upward, thus causing the hinge block 26 to pivot about the pivot pin 33 and to open the lid 11. However, in the prior art machine 1, the distance between the centerlines of the front bore 34 and the rear bore 31 is approximately 1 inch. This is the lifting moment arm via which the gas spring 41, acting in concert with a matching spring on the hinge assembly 12, must lift the entire weight of the lid 11. A typical lid 11 of 1 inch thick Lexan can weigh upwards of 40 pounds, thus requiring gas springs 41 with a lifting capacity of 150 lbs. Furthermore, the lifting moment arm of approximately 1 inch is practically a minimum, thus no fore and aft adjustment of spring position on the block 26, and, therefore, no accompanying adjustment of spring tension, is available with the prior art machine 1. Finally, the effect of the short lifting moment arm and the radius of the rear lip 24 allows the lid 11 to be raised to a maximum angle of only approximately 45 degrees from horizontal, as shown in FIG. 3. This limits the amount of clear space between the raised lid 11 and the tub 2 which an operator has available to place and retrieve food packages from the tub 2.

III. The Inventive Hinge Assembly

Figure 6:
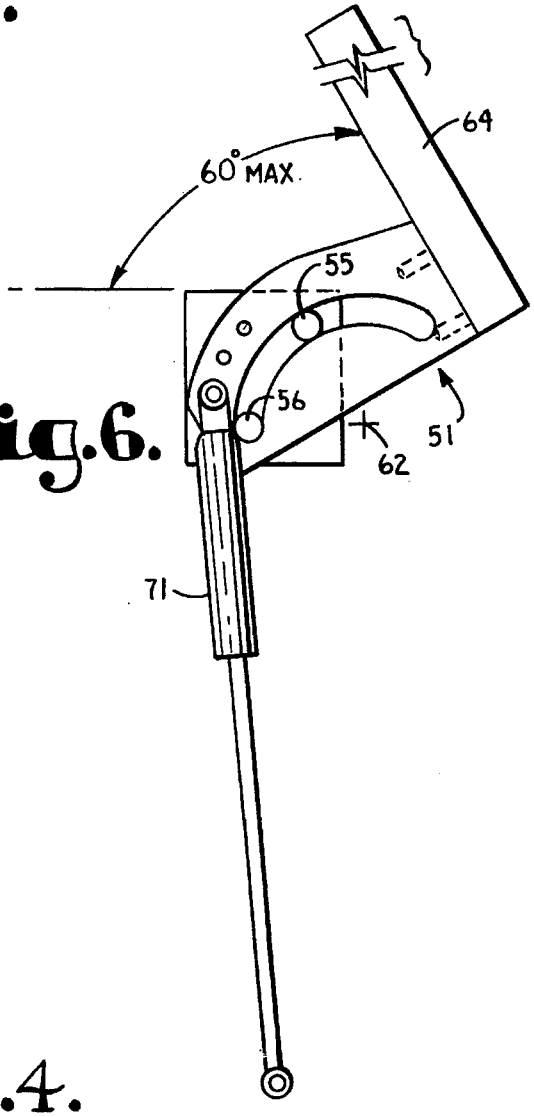
FIG. 6 is a fragmentary, partially schematic view of an assembled hinge assembly according to the present invention, illustrating the attached lid in an open position.
Figure 4:
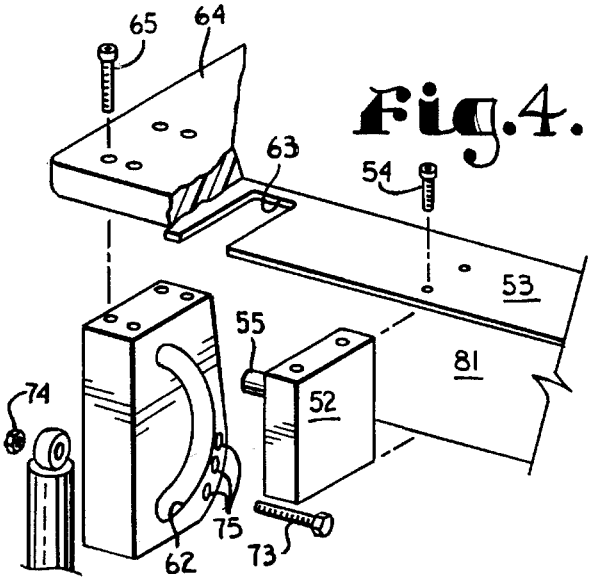
FIG. 4 is a fragmentary, exploded view of the hinge assembly according to the present invention.

Referring to FIGS. 4–6, a hinge assembly according to the invention is generally indicated at 51. The assembly 51, shown in exploded view in FIG. 4, includes a hinge mounting plate 52 which is attached to the underneath side of a rear tub lip 53 via screws 54. It should be noted that the rear lip 53 is square instead of being radiused like the rear lip 24 in FIGS. 1–3. A pair of hinge pins 55 and 56 are attached to and extend outward from the hinge plate 52. The hinge pins 55 and 56 extend into and through an arcuate slot 60 in a hinge block 61. The arcuate slot 60 extends completely through the hinge block 61. The arc of the slot 60 has a radial center, indicated at 62 in FIGS. 5 and 6. The hinge block 61 is sized and positioned to move up and down through a slot 63 in the rear tub lip 53. The hinge block 61 is attached to the bottom rear side of a lid 64 via screws 65. The lid 64 may be identical to the lid 11 in FIGS. 1–3. As an alternative, it is contemplated that the lid 64 can be made of cast aluminum, which can be formed to yield a greater volume of interior space than a conventional Lexan lid. A gas spring 71 has a top connector 72 pivotally attached to the hinge block 61 via a bolt 73 and nut 74, with the bolt 73 extending through a selected one of a number of through bores 75. The gas spring 71 is also pivotally attached via a bottom connector 76 to the machine 81. Although not shown, the lid 64 also has perimeter seals for seating securely against the rear tub lip 53 as well as the remainder of the tub lip (not shown) when a vacuum is drawn by the machine 81.

Referring to FIGS. 5, the lid 64 is shown closed in a vacuum position, with the gas spring 71 compressed. At FIG. 6, the vacuum is released and the gas spring 71 acts to raise the lid 64. The hinge action of the arcuate slot 60 within the hinge block 61 riding on the pins 55 and 56 creates a virtual pivot point at the radial center 62 of the arcuate slot 60. This means that the lid 64 is actually lifted up and over the tub rear lip 53, thus eliminating the need for the radiused rear angle on the lip 53 required in prior art machines such as the machine 1. Furthermore, the location of the effective pivot point at the radial center 62 of the slot 60 creates a moment arm of about 2 and ½ inches, instead of the 1 inch moment arm of the prior art. This means that a pair of gas springs with a lifting capacity of 75 pounds each is more than adequate to lift the 40 pound lid 64. It also means that the attachment point of the gas spring 71 to the hinge block 61 can be adjusted to adjust spring tension for different lid weights, aging springs or different working conditions, etc. This is indicated by the multiple through bores 75 in the hinge block 61. Thus, even with a spring lifting capacity of the gas springs 71 of about one half of the prior art requirements, a greater margin of error is still provided to accommodate for the effects of a cold working environment and aging springs. An additional advantage is that considerably less stress is placed on all working components of the hinge assembly 51 and the lid 64 by the lower spring tensions.

It is to be understood that while certain forms of the present invention have been illustrated and described herein, it is not to be limited to the specific forms or arrangement of parts described and shown.

What is claimed and desired to be secured by Letters Patent is as follows:

1. A vacuum packaging machine including a lid, said machine comprising:

A. a vacuum tub with a vertical front wall and a vertical rear wall and a perimeter lip, said perimeter lip including a horizontally level rear lip portion extending along and directly to the rear wall of said tub;

b. a stationary hinge plate with a pair of pins protruding therefrom, said hinge plate being connectable to said machine;

c. a movable hinge block with a curved slot formed therein, said hinge block being connectable to said lid and said curved slot being sized to accommodate and to slide along both of said protruding pins as said hinge block and said lid is moved between open and closed positions and said hinge block is positioned within a slot formed within said rear lip portion of said vacuum machine and moves in said rear lip slot as said lid is opened and closed such that a virtual pivot point is created behind said machine about which said lid pivots relative to said machine whereby said lid pivots upward and backward about said virtual pivot point, thus avoiding contact with said horizontally level rear lip portion of said tub; and d. a spring mechanism positioned to bias said hinge block and said lid toward said open position, said spring mechanism being connectable between said machine and said hinge block whereby said spring mechanism biases said lid toward an open position.

2. A vacuum packaging machine as in claim 1, wherein:

a. said hinge assembly allows said lid to be pivoted upward to an angle of approximately 60 degrees from horizontal.

3. A vacuum packaging machine as in claim 1, wherein:

a. said hinge block has a plurality of attachment points to which said spring mechanism can be selectively attached to vary a moment arm of said spring mechanism.

4. A vacuum packaging machine as in claim 3, wherein:

a. said spring mechanism is a gas spring.

5. A vacuum packaging machine including a vacuum tub having a vertical fron wall and a vetical rear wall into which tub food packages to be sealed are placed and a lid pivotally attached to said machine to selectively cover and seal said vacuum tub such that a vacuum can be drawn therein, and comprising:

a. a perimeter lip at least partially surrounding said tub, said lip including a horizontally level rear portion extending along and directly to the rear wall of said tub;

b. a hinge assembly pivotally connecting said lid to said machine, said hinge assembly including:

i. a stationary hinge plate connected to said machine with a pair of pins spaced apart and protruding outward therefrom;

ii. a movable hinge block connected to said lid, said hinge block including a curved slot, said slot being sized to accommodate and to slide along said protruding pins as said hinge block and said lid is moved between open and closed positions, said pins and said curved slot creating a virtual pivot point behind said machine about which said lid pivots relative to said machine whereby said lid pivots upward and backward about said virtual pivot point, thus avoiding contact with said horizontally level rear lip portion of said tub; and iii. a gas spring mechanism attached between a rear side of said machine and said hinge block, said spring mechanism biasing said hinge block, and thus said lid, toward said open position, said hinge block including a plurality of attachment points to which said spring mechanism can be selectively attached to vary the moment arm of said spring mechanism.

6. An apparatus as in claim 5, wherein:

a. there are a pair of said hinge assemblies pivotally connecting said lid to said machine.

7. An apparatus as in claim 5, wherein:

a. said hinge assembly allows said lid to be pivoted upward to an angle of approximately 60 degrees from horizontal.

* * * * *